US005579540A

United States Patent [19]

Walker

[11] Patent Number: 5,579,540

[45] Date of Patent: Dec. 3, 1996

[54] HAT/BAG COMBINATION

[76] Inventor: Janice Walker, 15-B Ashdale Avenue, Toronto, Ontario, Canada, M4L 2Y6

[21] Appl. No.: 241,804

[22] Filed: May 11, 1994

[51] Int. Cl.[6] ..... A42B 1/00

[52] U.S. Cl. ..... 2/209.11; 2/175.1; 2/175.2; 2/195.1; 2/209.12; 2/DIG. 2; 383/4; 383/75

[58] Field of Search ..... 2/171, 175.1, 175.2, 2/181, 195.1, 195.7, 209.11, 209.12, 417, 418, DIG. 2, 184; 150/106; 383/4, 75; 446/46

[56] References Cited

U.S. PATENT DOCUMENTS 919,984 4/1909 Powell et al. ..... 2/209.11

1,816,346 7/1931 Silverstein ..... 2/DIG. 2

5,303,427 4/1994 Fishbaine ..... 2/209.11

*Primary Examiner*—Dana Biefeld

[57] ABSTRACT

A changeable shape clothing accessory which can be used as either a hat or a hand bag is made from foldable material forming an endwall, a sidewall and a collar or brim extending outwardly from the sidewall. The sidewall has a lower edge with a fold which reverses upon itself and which is secured outwardly of and back to the sidewall forming a thickened band around the accessory. The collar has an interior end trapped in the fold which forms the band. The band provides a reinforced region about which the different parts of the accessory are foldable.

4 Claims, 8 Drawing Sheets

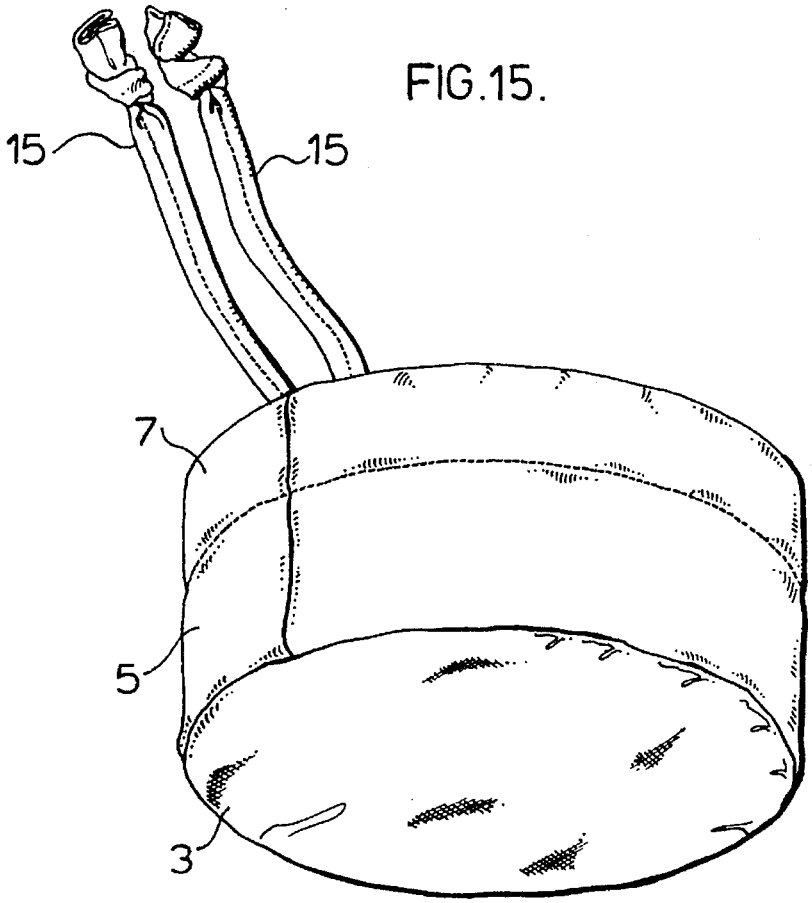
FIG.15.
FIG.6.
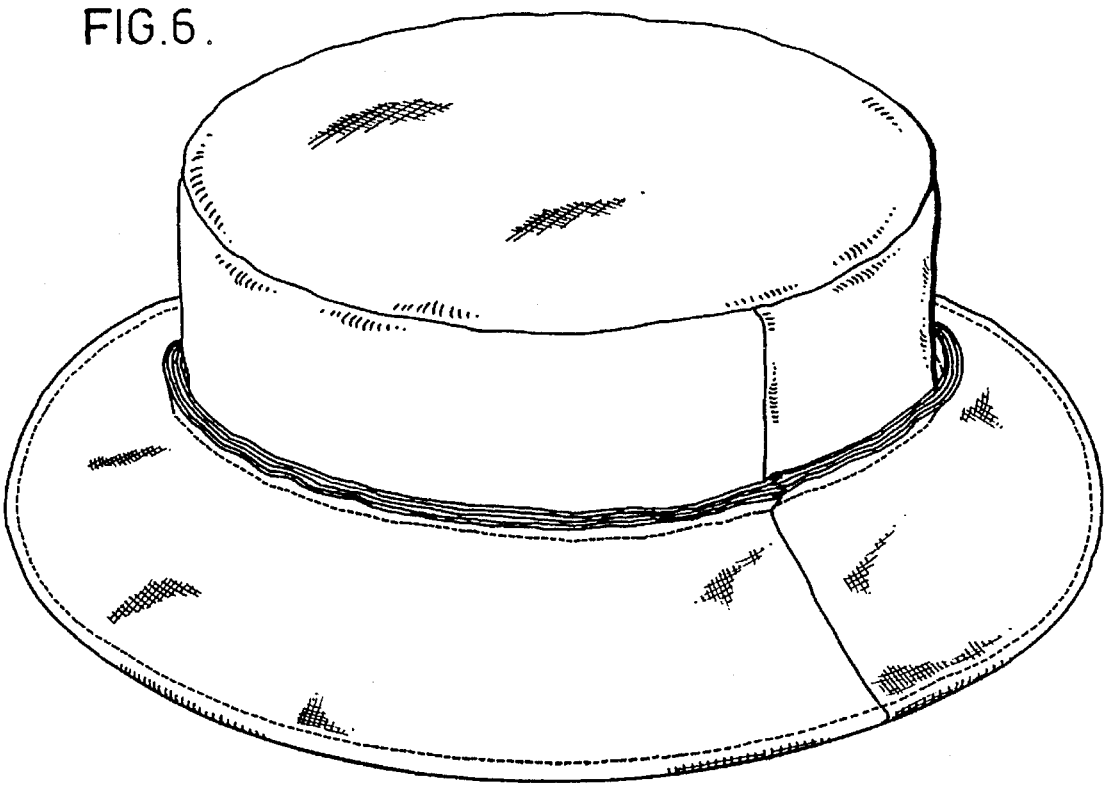

HAT/BAG COMBINATION

FIELD OF THE INVENTION

The present invention relates to a clothing accessory, i.e. either a hat or a hand bag made of foldable material and changeable to different shapes.

BACKGROUND OF THE INVENTION

Hats are becoming more and more important in everyday use particularly in view of the increased threat of ultraviolet light exposure caused by thinning of the ozone layer. Accordingly, many people are buying hats to cover themselves against this exposure.

In addition, many people buy hats simply for aesthetic purposes. In most cases, people will attempt to match both the style and the color of the hat with their wardrobe. This generally necessitates the purchasing of different hats for different attires. The same is true of hand bags where people attempt as much as possible to match a hand bag to an outfit which requires an inventory of bags.

SUMMARY OF THE INVENTION

The present invention relates to a clothing accessory which is changeable to different shapes according to the particular fashion statement to be made by the user of the accessory. The accessory itself which is in the form of either a hat or a hand bag is made of foldable material forming an endwall, a sidewall and a collar extending outwardly from and surrounding the sidewall. The sidewall has a lower edge with a fold which reverses upon itself and which is secured outwardly of and back to the sidewall forming a thickened band around the accessory. collar has an interior end trapped in the fold which forms the band. The headband provides a reinforced region about which the different parts of the accessory can be folded.

BRIEF DESCRIPTION OF THE DRAWINGS

The above as well as other advantages and features of the present invention will be described in greater detail according to the preferred embodiments of the present invention in which:

FIG. 6 is a perspective view showing assembly of the hat materials of FIG. 3 joined with the hat materials of FIG. 5;

FIG. 15 is a perspective view of the hand bag folded to a different shape from that shown in FIGS. 13 and 14.

DETAILED DESCRIPTION ACCORDING TO THE PREFERRED EMBODIMENTS OF THE PRESENT INVENTION

Figure 1:
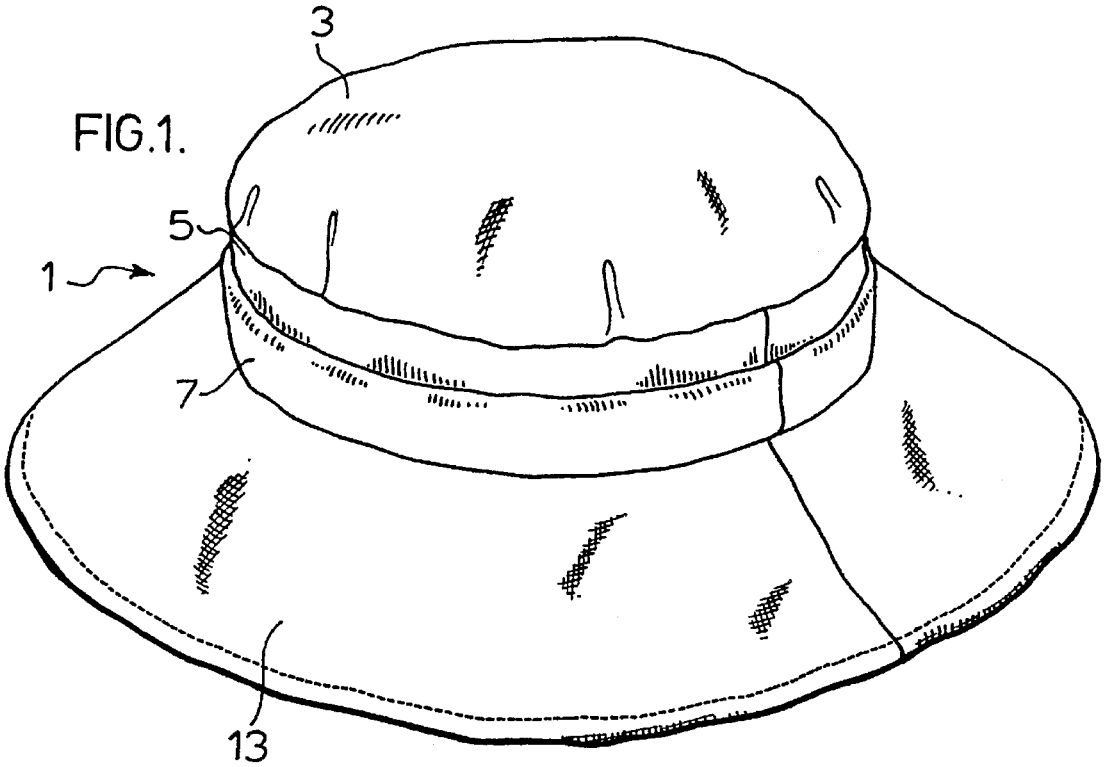
FIG. 1 is a perspective view of a hat according to a preferred embodiment of the present invention.
Figure 2:
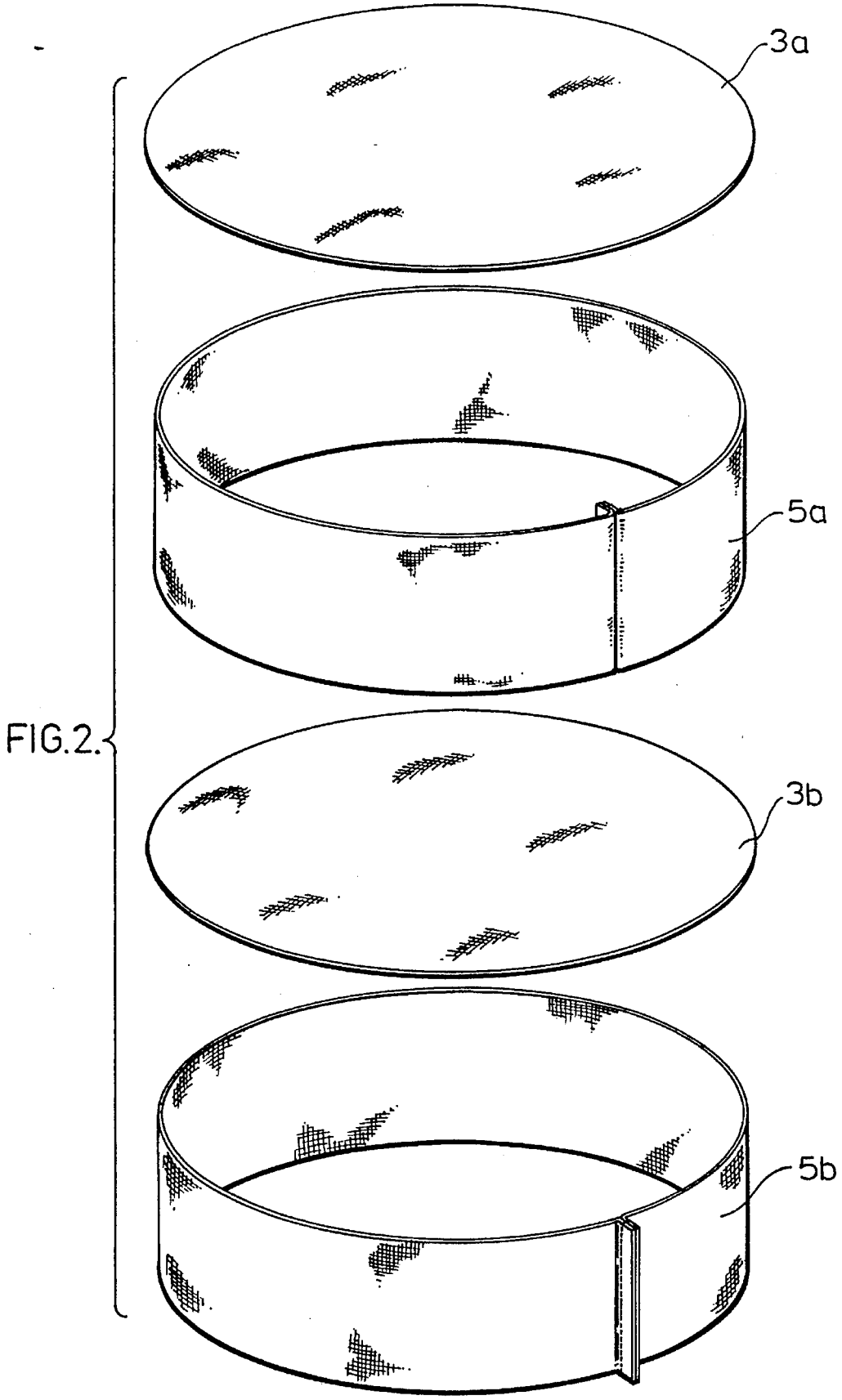
FIG. 2 is an exploded perspective view of the materials forming the sidewall and top in preparation of making the hat of FIG. 1.

FIG. 1 shows a hat generally indicated at 1. This hat is formed by foldable material such as natural fibre material including different types of cottons, wools, etc. However, other foldable materials including synthetic materials can equally as well be used in the formation of the hat.

The hat includes an end wall or top 3, a sidewall 5, a reinforced headband 7, and a collar or brim 13 extending outwardly around the sidewall and headband of the hat. The hat is easily changed from the hat shape or configuration of FIG. 1 to, for example, any of the configurations shown in FIGS. 10 through 12 of the drawings. Additional shapes not shown in the drawings can also be formed through simple manipulations of the hat.

In accordance with the preferred embodiments shown in the drawings, the hat has a multiple layer construction which is best described having reference to FIGS. 2 through 5 of the drawings.

The top of the hat is formed by two circular pieces 3*a* and 3*b*. The sidewall is formed by two narrow elongated band like pieces which are formed into loops 5*a* and 5*b*. The hat brim is formed by a further pair of elongated pieces 13*a* and 13*b* where opposite ends of each of these pieces are secured upon themselves enclosing the brim.

Again, according to a preferred embodiment, each of the pieces 3*a*, 5*a* and 13*a* is preferably cut from a single larger piece of material. The individual pieces 3*b*, 5*b* and 13*b* are preferably cut from a different larger piece of material with the two large starting pieces of material being noticeably different in appearance from one another. For instance, each of the pieces 3*a*, 5*a* and 13*a* may be cut from a single colored material whereas the pieces 3*b*, 5*b* and 13*b* may be cut from a patterned material.

Figure 3:
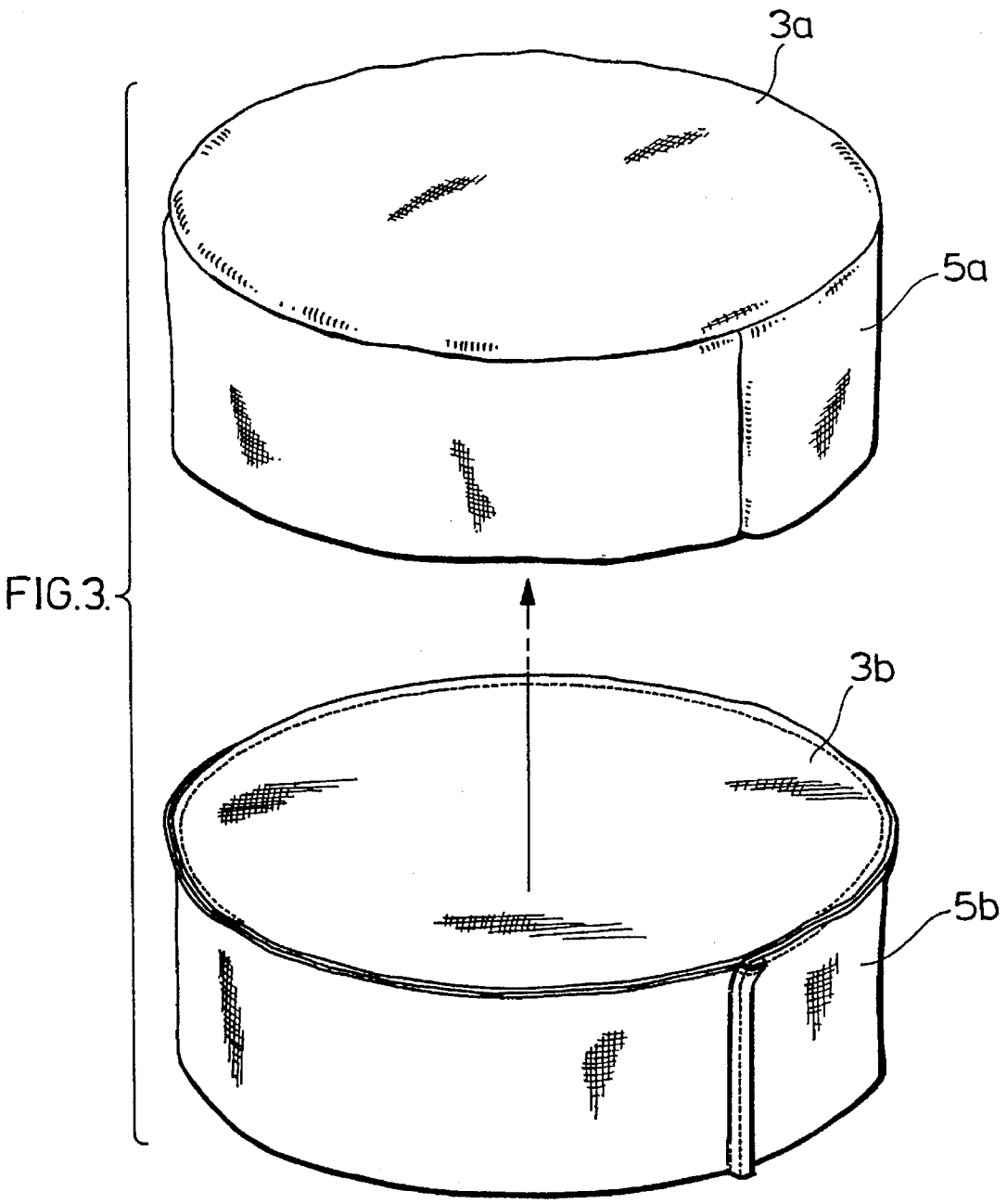
FIG. 3 shows the materials of FIG. 2 in a partially assembled form.

The initial step taken in forming the hat is to secure the top forming piece 3*a* with the sidewall forming piece 5*a*. This can be done by stitching or any other means of securing. The top forming piece 3*b* is secured with the top forming piece 5*b*. This results in the formation of two separate top and sidewall subcombinations as shown in FIG. 3. One of those subcombinations will have one exterior ornamentation and the other subcombination will have a different interior ornamentation. The two subcombinations are then secured with one another to form a double layer top and sidewall. This top and sidewall combination along with the remainder of the components of the hat to be described later in detail is reversible to expose either one of the two surface treatments referred to above.

Figure 4:
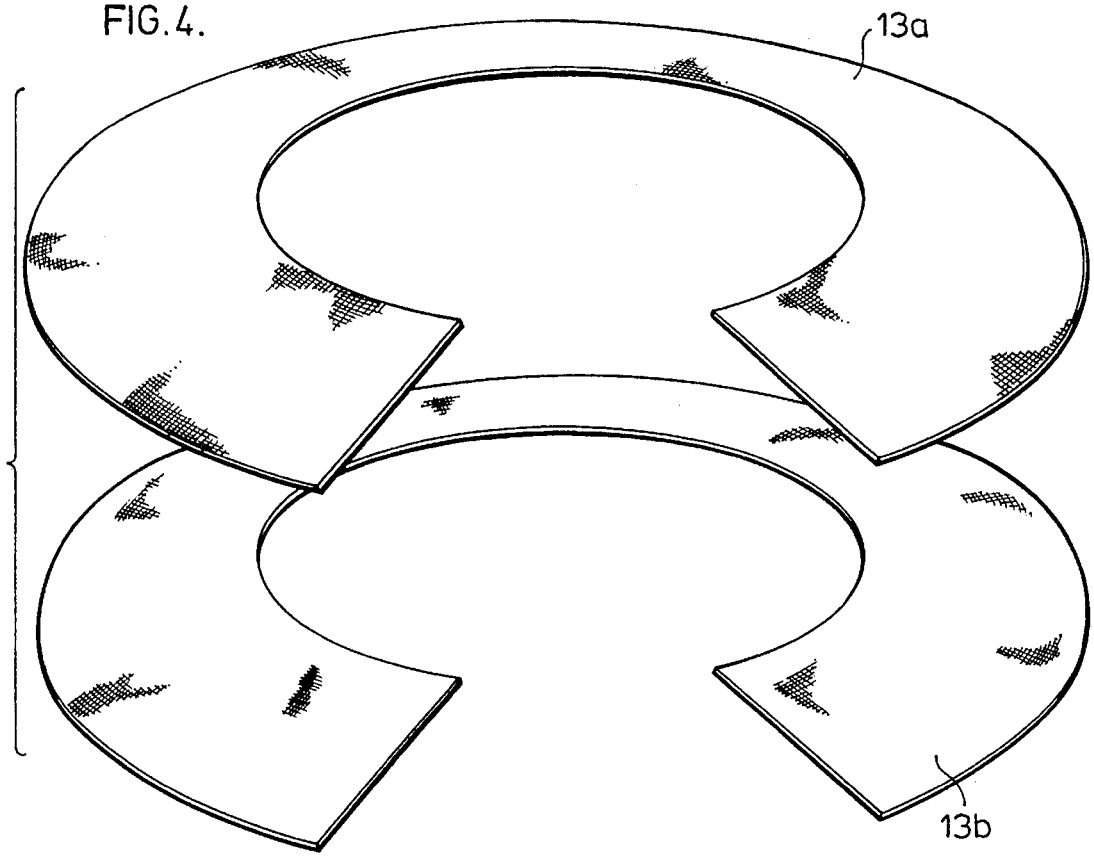
FIG. 4 is an exploded view of the materials forming the brim of the hat of FIG. 1.
Figure 5:
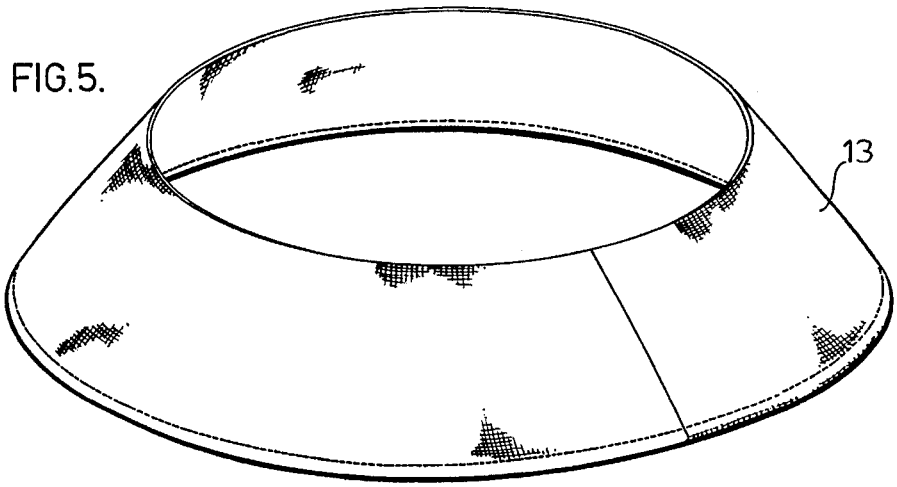
FIG. 5 is a perspective view showing the materials of FIG. 4 when assembled.

The brim of the hat which is put together as shown in FIGS. 4 and 5 of the drawings, as earlier mentioned comprises two separate strips of material 13*a* and 13*b*. Each of these strips is formed into a loop and the two strips are secured to one another. The upper side of strip 13*a* will have the same ornamentation as the exterior surface of top portion 3*a* and sidewall portion 5*a* while the undersurface of strip 13*b* will have the same ornamentation the interior surface of top portion 3*b* and sidewall portion 5*b*.

The two strips when secured together with one another are shown in FIG. 5 of the drawings.

Figure 8:
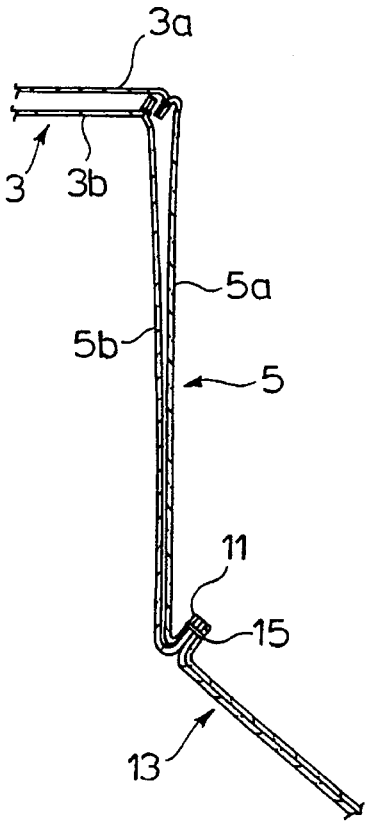
FIG. 8 is a sectional view along the lines 8—8 of FIG. 7.

The next step is to secure the brim to the sidewall as shown in FIG. 6 of the drawings. To accomplish this the lower end of the sidewall is given a first small fold indicated at 11 in FIG. 8 of the drawings. The interior end of the brim 13 is given a slight fold 15 also shown in FIG. 8. The two folds 11 and 15 are then secured by sewing or the like to one another.

Figure 9:
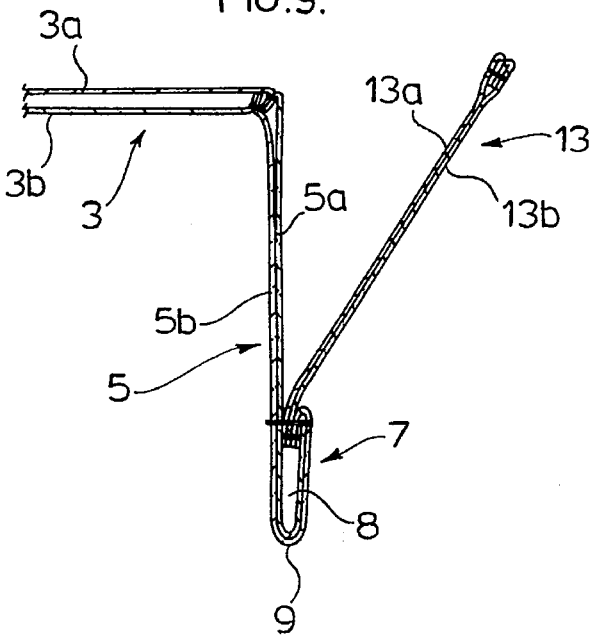
FIG. 9 is a sectional view along the lines 9—9 of FIG. 7.

The next step in completing the construction of the hat is to make a larger fold 9 at the bottom of the sidewall with this fold reversing back to the outside of and secured to the sidewall as will be seen in FIG. 9 of the drawings. The sewing between the two smaller folds 11 and 15 is hidden to the inside of the larger fold 9 and the interior end of the brim 13 is trapped within the fold. This produces a thickening of the hat material resulting in the formation of the headband 7.

Another feature to be noted in FIG. 9 of the drawings is that the two smaller folds 11 and 15 prevent the larger fold 9 from completely closing leaving a small gap 8 interiorly of the headband around the hat. The provision of this gap enables, according to the embodiment shown in FIGS. 13 and 14 of the drawings, the fitting of a draw string 6 within the band to be described later in detail.

Figure 7:
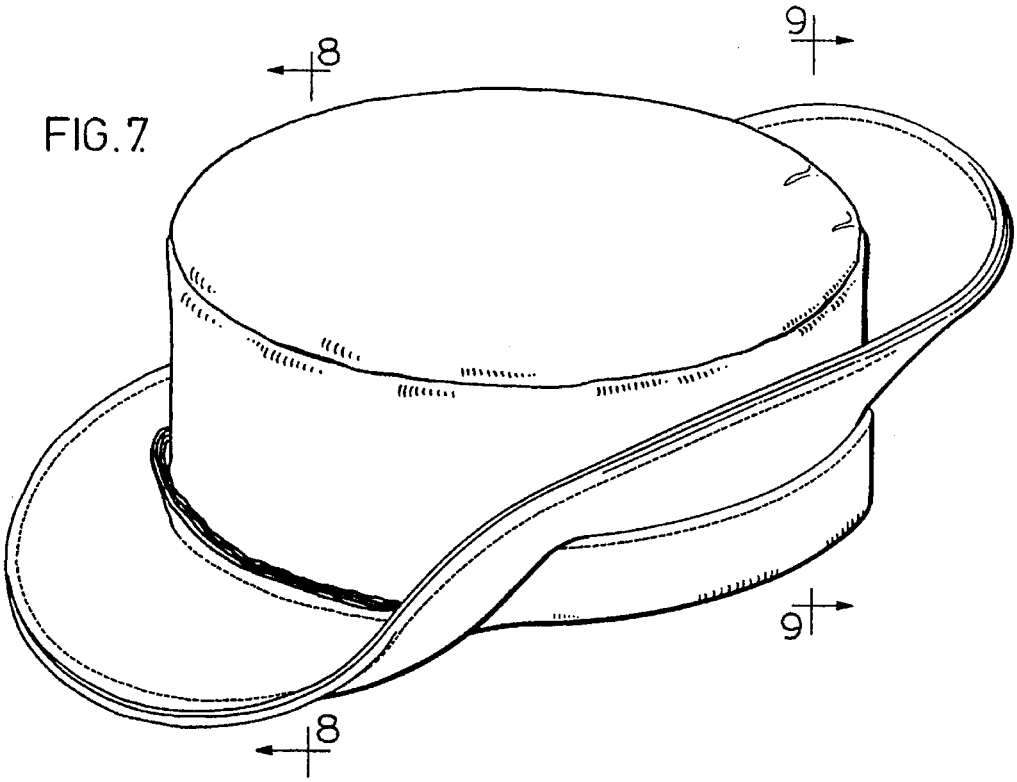
FIG. 7 is a perspective view showing further assembly of the hat of FIG. 6.

FIG. 7 of the drawings shows the hat as it is being folded to form the headband 7 in the right hand side of the drawing with the folding not yet being completed in the left hand side of FIG. 7. It is to be noted that once the fold is formed the rough sewn edges where the brim and sidewall are secured to one another are hidden interiorly of the fold.

Figure 10:
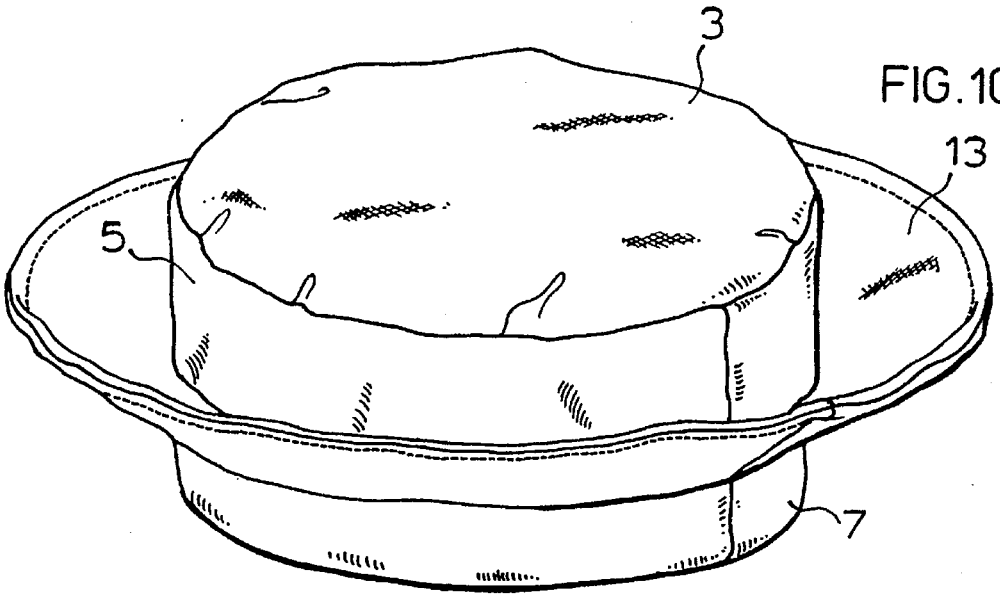
FIG. 10 is a fully assembled perspective view of the hat with the brim folded in a different position from that shown in FIG. 1.

FIG. 1 of the drawings shows the hat in one particular configuration with the brim turned down and the fold located to the outside of the hat. The fold provides a region about which the hat can be folded to various different configurations. FIG. 10 shows one of these configurations where, the top and sidewall of the hat is turned inside out in comparison to FIG. 1. The brim positioning is not changed so that in the FIG. 10 position two different ornamentations appear to the outside of the hat, one on the underside of the brim and around the headband and the other on the top side of the brim and around the sidewall and on the top of the hat. In FIG. 1, however, only one color or ornamentation is seen to the outside of the hat.

Figure 11:
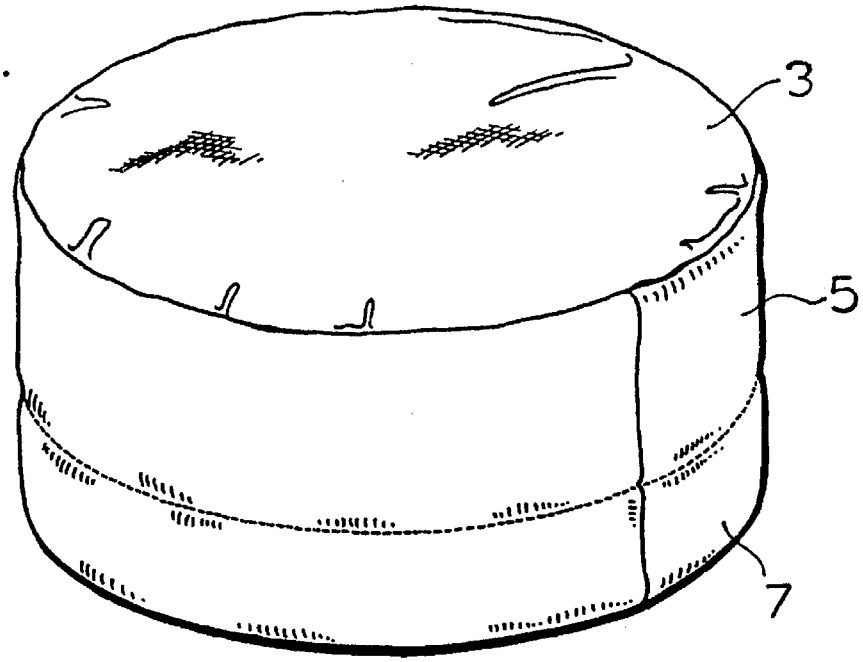
FIGS. 11 and 12 are perspective views of different shapes achieved by the folding of the hat of FIG. 1.

FIG. 11 of the drawings shows the hat with the headband down and the entirety of the brim folded to the inside of the hat.

Figure 12:
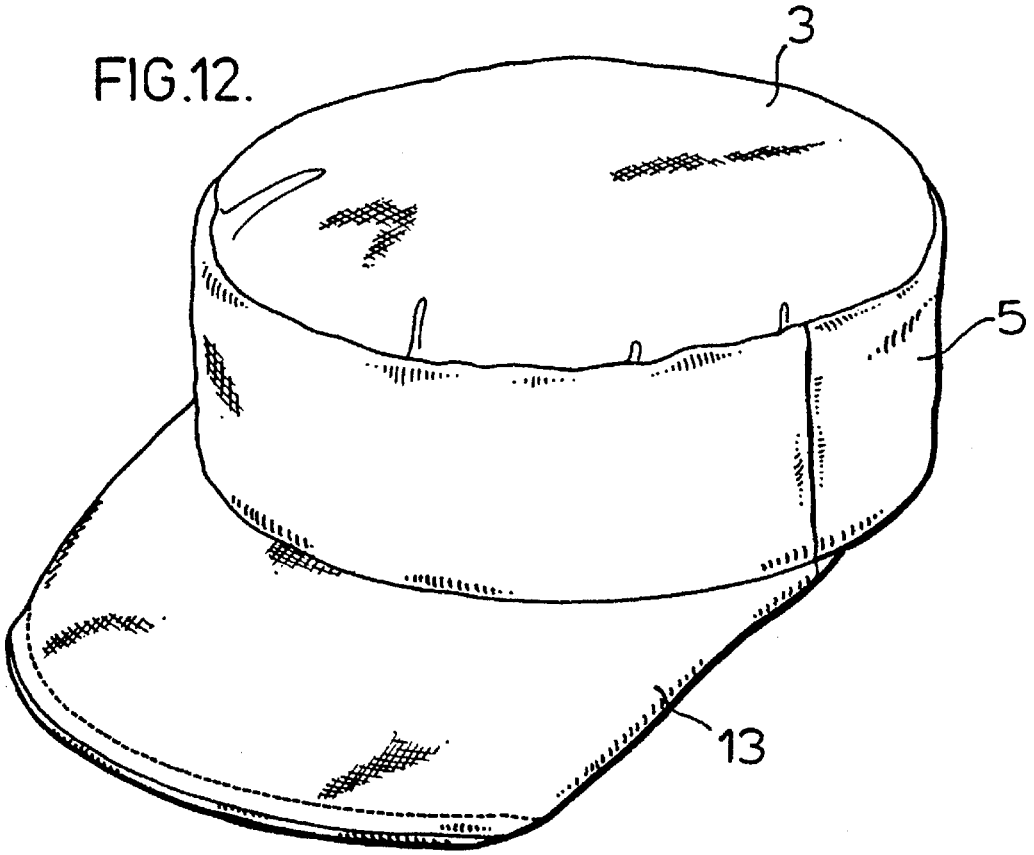

In FIG. 12 of the drawings, the hat is folded such that the entirety of the headband is hidden to the inside of the hat and part of the brim is pulled out to form a peak cap.

The ornamentation appearing to the outside of the hat of FIG. 11 is different from the ornamentation appearing to the outside of the hat shown in FIG. 12.

As earlier noted, many further different hat configurations can be formed over and above those shown in the drawings.

Figures 13, 14:
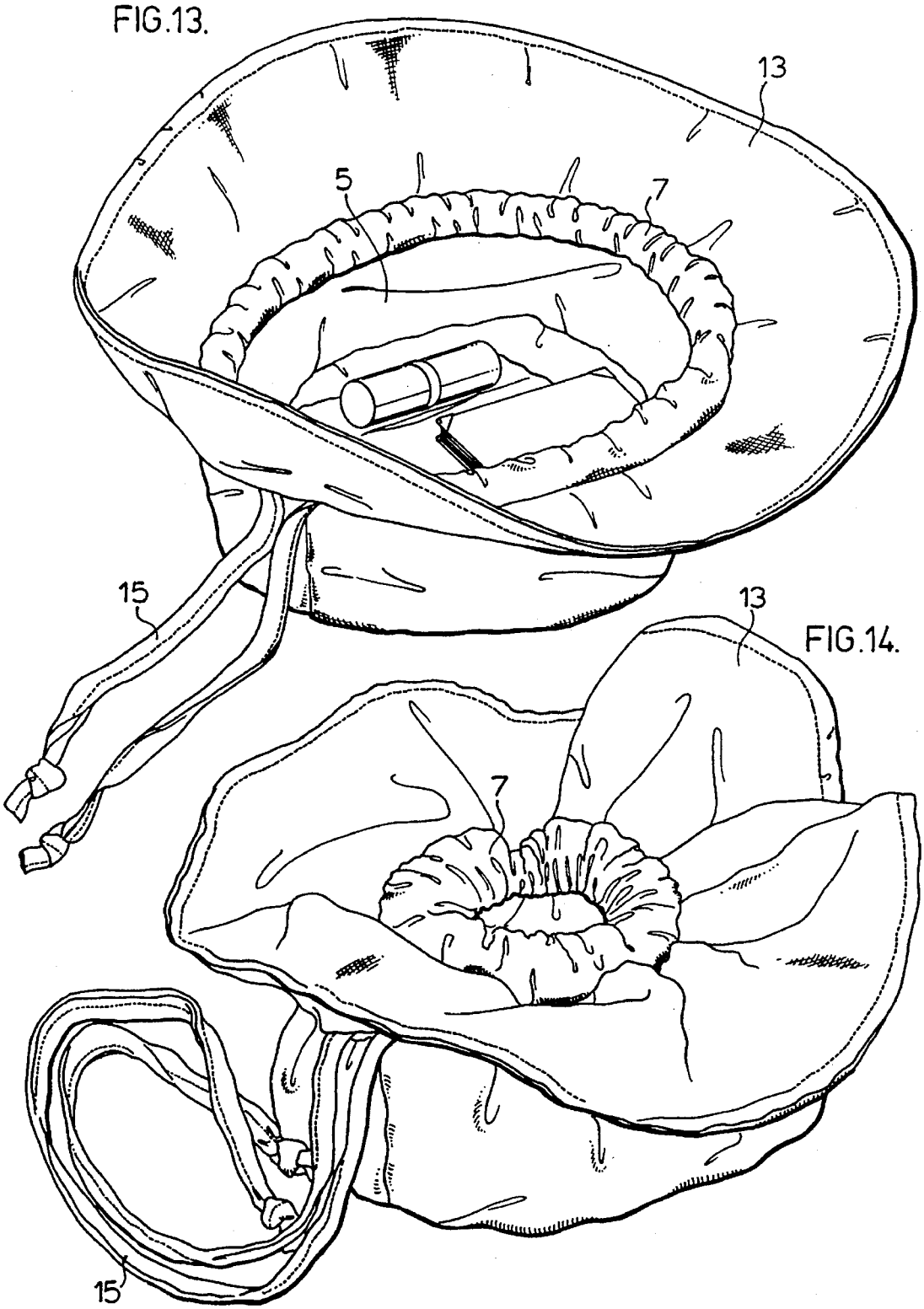
FIGS. 13 and 14 are perspective views of a hand bag of FIG. 1 fitted with a draw string according to still a further preferred embodiment of the present invention.

FIGS. 13 and 14 of the drawings show a further embodiment of the invention in which the clothing accessory while maintaining its ability to change to different shapes has the additional feature that it can be used as a hand bag with a drawstring. The hand bag is made with all of the same components including the sidewall 5 capped with top or end wall 3 and surrounded by the band 7. The collar 13 is located outwardly of the sidewall. In addition, the drawstring 6 is fitted interiorly of the band 7 which, as earlier described and as shown in FIG. 9 of the drawings, has an interior hollow 8 for receiving the drawstring 15.

The accessory shown in FIGS. 13 and 14 of the drawings can be used in either its hat mode even when fitted with drawstring 6 or can be used as a purse or a handbag in which case the end wall 3 becomes the bottom of the purse and band 7 becomes the mouth of the bag. The bag is initially left open as shown in FIG. 13 to drop product into the bag and which can then be closed as shown in FIG. 14 by tightening the drawstring 6. The collar 13 of the hat provides a very aesthetically appealing cuff around the mouth of the bag.

FIG. 15 of the drawings shows the handbag reversed or turned inside out from the configuration of FIGS. 13 and 14. Accordingly, the color or pattern of the hand bag of FIG. 15 will be different and useable with different outfits.

Although various preferred embodiments of the present invention have been described herein in detail, it will be appreciated by those skilled in the art, that variations may be made thereto without departing from the spirit of the invention or the scope of the appended claims.

Embodiments of the invention in which an exclusive property or privilege is claimed are defined as follows:

1. A changeable shape clothing accessory comprising foldable material forming an endwall, a sidewall and a collar around said sidewall, said sidewall having an edge with a folded region formed by a first fold and a second fold which reverses upon itself and which is secured back to said sidewall through said first fold forming a thickened band around said accessory, said collar having an interior end trapped between said first fold and said sidewall in said folded region which forms said band and said band providing a reinforced region about which said accessory is foldable.

2. A clothing accessory as claimed in claim 1, wherein said band has a interior hollow bordered on one end by said first fold and said interior end of said collar and on the other end by said second fold and said interior hollow is fitted with a draw string.

3. A clothing accessory as claimed in claim 1, wherein said accessory is a hat and is foldable to opposite sides of said band to different hat configurations.

4. A clothing accessory as claimed in claim 1, wherein said accessory is a handbag and is foldable to opposite sides of said band to different handbag configurations.

* * * * *